United States Patent [19]

Leasher

[11] 4,246,728

[45] Jan. 27, 1981

[54] CONDUIT END TREATING TOOL

[76] Inventor: Arthur L. Leasher, 3447 N. Branch Dr., Beaverton, Mich. 48612

[21] Appl. No.: 80,943

[22] Filed: Oct. 1, 1979

[51] Int. Cl.[3] ..... B24B 19/00

[52] U.S. Cl. ..... 51/241 S; 15/104.04; 15/104.05; 51/245

[58] Field of Search ..... 51/241 S, 245, 206 R; 82/4 C; 15/104.03, 104.04, 104.05, 104.09, 104.18; 408/199, 211, 224; 83/178, 180, 187

[56] References Cited

U.S. PATENT DOCUMENTS

| | | | |
|---|---|---|---|
| 1,305,759 | 6/1919 | Wernette | 51/245 |
| 1,395,245 | 11/1921 | Anderson | 51/206 R |
| 1,397,660 | 11/1921 | Rouze | 51/245 |
| 1,657,569 | 1/1928 | Fennell | 51/206 R |
| 1,774,567 | 9/1930 | Raphael | 51/104.04 |
| 3,571,980 | 3/1971 | Fisher | 51/206 R |

*Primary Examiner*—Othell M. Simpson
*Assistant Examiner*—Roscoe V. Parker
*Attorney, Agent, or Firm*—Learman & McCulloch

[57] ABSTRACT

A tool for cleaning, deburring, burnishing, or otherwise treating an end of a tubular conduit comprises a rotatable body coupled to a carrier provided with an abrading substance. In one form the carrier may be accommodated within the conduit, whereas in another form the carrier is adapted to accommodate the conduit. In each case the carrier is axially slotted to enable it to expand and contract radially to cause the abrading material to engage the conduit. The body and the carrier are telescoped for relative movement and are provided with complementally tapered surfaces which react in response to relative telescopic movements to effect radial expansion and contraction of the carrier.

15 Claims, 13 Drawing Figures

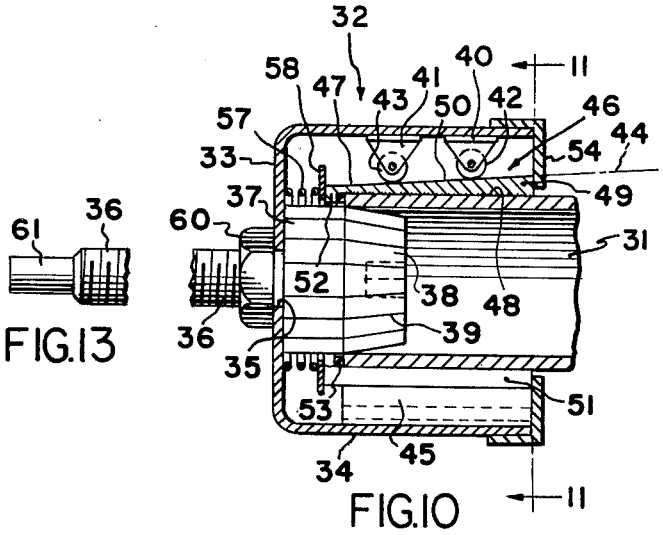
FIG.10
FIG.13
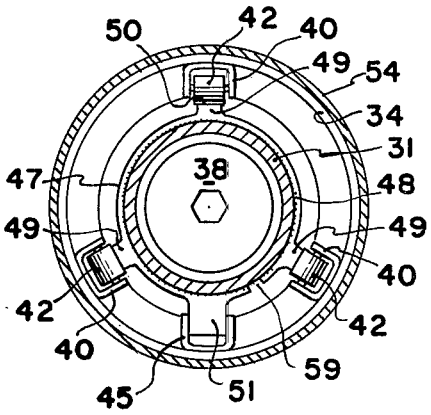
FIG.11
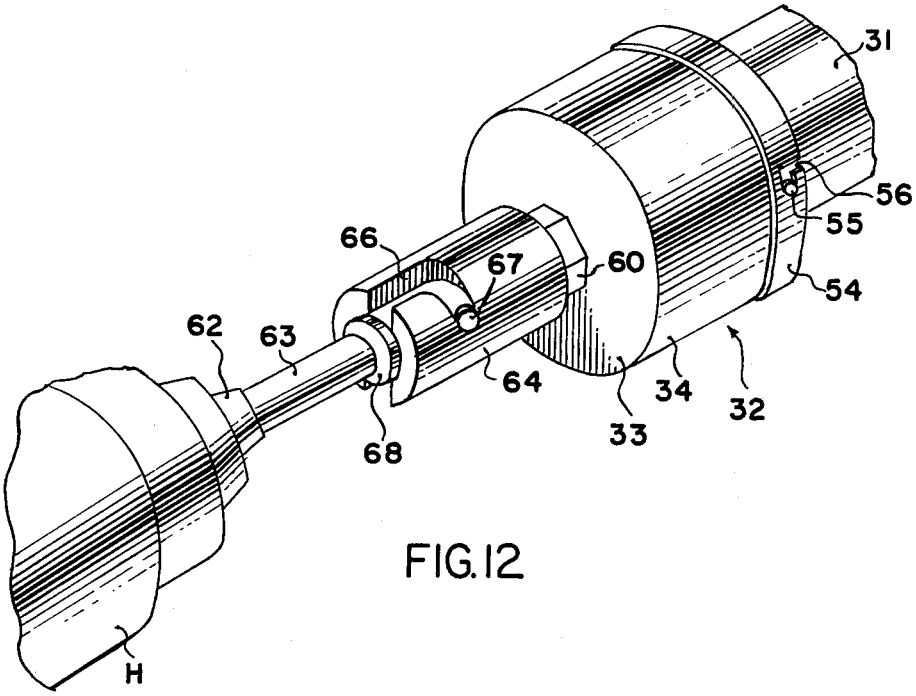
FIG.12

CONDUIT END TREATING TOOL

BACKGROUND OF THE INVENTION

The invention relates to a portable tool especially adapted for the cleaning, deburring, burnishing, and the like of the ends of conduits and fittings that are to be joined to one another. Various kinds of tools for such purpose have been proposed heretofore, but the known tools have disadvantages among which are lack of portability and the inability to function properly on conduits of differing diameters or wall thickness. Tools constructed according to the invention overcome such disadvantages by their being adapted for use with hand-held rotary motors and by being radially expansible and contractile so as to treat not only conduits of different diameters, but also of different wall thickness. In addition, a tool constructed in accordance with one embodiment of the invention is capable of treating simultaneously both the inner and outer surfaces of a conduit or fitting.

SUMMARY OF THE INVENTION

A tool constructed in accordance with one embodiment of the invention is adapted to deburr, clean, burnish, or otherwise treat the inner surface of a plastic or metal pipe or fitting and compirses a rotatable body adapted for removable mounting on the rotary shaft of a drill or other portable motor. The rotatable body telescopingly accommodates an axially slotted carrier the outer surface of which is provided with an abrading material. The confronting surfaces of the body and the carrier are complementally tapered so that relative axial movements of the body and carrier effect radial expansion and contraction of the carrier, thereby enabling the abrading material to engage and disengage the inner surface of the conduit. The carrier is drivingly coupled to a body for conjoint rotation with the latter and has radially extending parts which are capable of engaging an end of the conduit following insertion of the body and carrier in such conduit. Engagement of such parts with the end of the carrier effects axial movement of the body relative to the carrier so as to cause radial expansion of the latter, thereby causing the abrading material to engage the inner surface of the conduit. A spring constantly acts on the carrier to bias it in such direction that, when the body and carrier are withdrawn from the conduit, the carrier is capable of radial contraction, thereby facilitating withdrawal of the body and carrier from the conduit.

In another embodiment of the invention a rotatable, cylindrical body accommodates a longitudinally slotted abrading material carrier that is coupled to the body for conjoint rotation, but in this embodiment the carrier is of such diameter as to encircle the conduit. The abrading material is fitted to the carrier so as to confront the external surface of the conduit. Again, the carrier is provided with parts which may engage the end of the conduit to effect axial movement of the carrier relative to the body. Cooperable means react in response to such relative movement of the body and carrier to contract the latter radially and cause the abrading material to bear against the external surface of the conduit. In this embodiment the carrier also is biased by a spring to a position in which the carrier is radially expanded, thereby facilitating withdrawal of the conduit from the tool. If desired, the tool of the second embodiment may include a central reamer adapted to be accommodated within the conduit, thereby enabling both the internal and external surfaces of the conduit to be treated simultaneously.

DESCRIPTION OF THE DRAWINGS

Tools constructed in accordance with the invention are described in the following specification and are disclosed in the accompanying drawings, wherein:

FIG. 10 is a sectional view of a modified embodiment of the tool;

FIG. 11 is a sectional view taken on the line 11—11 of FIG. 10;

FIG. 12 is an isometric, fragmentary view of the embodiment shown in FIG. 10 in operative relation with a pipe to be treated and coupled to a driving motor; and FIG. 13 is a view of a modified drive shaft for the embodiment of FIG. 10.

DETAILED DESCRIPTION

Figure 2:
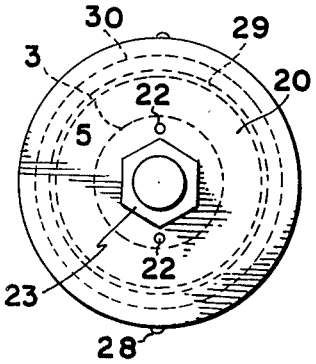
FIG. 2 is an elevational view of the tool as viewed from the left of FIG. 1.

A tool constructed according to the embodiment of FIGS. 1-9 is designated generally by the reference character 1 and comprises a body member 2 having a cylindrical portion 3 and a tapering portion 4. Fixed to and projecting from the cylindrical portion 3 is a threaded driving shaft 5 which, if desired, may include a reduced diameter, non-threaded shank 6. At the juncture of the cylindrical and tapered portions 3 and 4, respectively, is a raised, circumferential rib or bead 7, and between the latter and the free end of the tapered portion 4 is one or more similar beads 8. The radially outer surfaces of the beads 7 and 8 together form an inclined or tapering plane designated by the dash line 9.

The tool 1 also includes a carrier member 10 having a cylindrical portion 11 terminating at one end in a shoulder 12. Projecting from the shoulder is a plurality of circumferentially spaced, radially extending parts or lugs 13. The carrier member 10 is formed of a springy material and is axially slotted as at 14, thereby enabling the carrier to expand and contract radially.

Encircling the cylindrical portion 11 and bearing against the shoulder 12 is a wear ring 15 having a slot therein so as to enable it to expand and contract radially. Adhered to or otherwise fixed to the external surface of the cylindrical carrier portion 11 is an abrading material 16 such as sandpaper, emery cloth, and the like.

Extending radially inwardly of the cylindrical portion 11 of the carrier member is a plurality of circumferentially spaced ribs 17 having smooth, inclined surfaces 18 complemental to the inclination of the plane 9.

Coupling means 19 is provided for coupling the members 2 and 10 to one another and to the drive shaft 5. The coupling means comprises a disc 20 having a central opening 21 for the accommodation of the shaft 5 and a pair of axially extending drive pins 22 which may be accommodated in openings (not shown) formed in the cylindrical portion 3 of the member 2. The disc 20 is maintained snugly against the member by a nut 23. At the periphery of the disc 20 is a flange 24 which overlies a peripheral wall 25 of an annulus 26 which snugly, but slidably, receives the shoulder 12 of the carrier member 10. The inner surface of the annulus 26 is relieved as at 27 at circumferentially spaced intervals to accommodate the lugs 13 of the carrier member 10. The parts of the housing 19 are separably maintained in assembled relation by pins 28 carried by the flange 24 and which are accommodated in bayonet slots (not shown) formed in the wall 25.

Interposed between the disc 20 and the annulus 26 is a spring 29 one end of which bears against the disc 20 and the other end of which bears against a washer 30 which abuts the annulus 26. The spring 29 constantly biases the carrier member 10 axially of the body member 2 in such direction as to enable the carrier member to assume its radially contracted condition.

The tool of the embodiment of FIGS. 1–9 is intended for use in deburring, cleaning, or burnishing the inner surface of a conduit 31 such as a metal or plastic pipe or fitting. To condition the apparatus for operation, the parts of the tool will be assembled in the manner illustrated in FIG. 1. The carrier member 10 is introduced into the conduit 31 with the end of the conduit abutting the wear ring 15. At this stage the abrading material will not engage the conduit inasmuch as the carrier is in its contracted condition.

Figure 1:
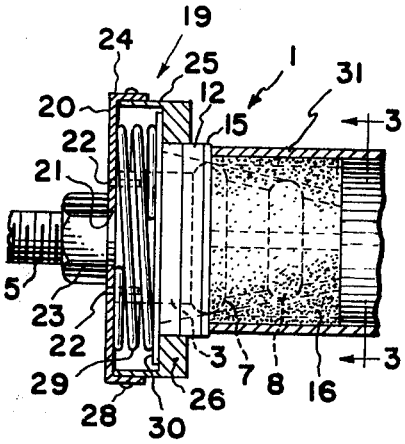
FIG. 1 is a sectional view taken on the line 1—1 of FIG. 3 and illustrating a tool according to one embodiment of the invention in operative association with a conduit to be treated.
Figure 3:
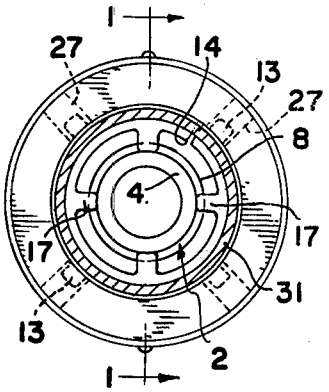
FIG. 3 is a sectional view taken on the line 3—3 of FIG. 1.
Figure 6:
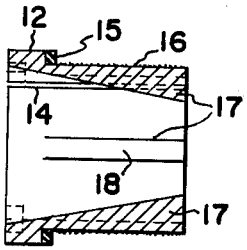
FIG. 6 is a view similar to FIG. 4, but taken on the line 6—6 of FIG. 5.
Figure 4:
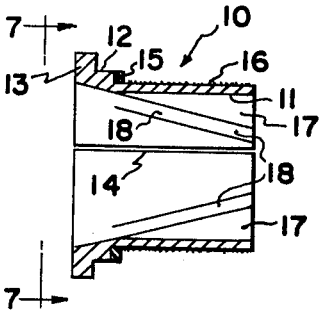
FIG. 4 is a sectional view of the abrading material carrier and taken on the line 4—4 of FIG. 5.
Figure 5:
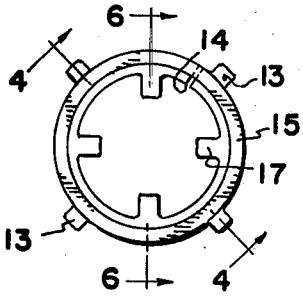
FIG. 5 is an end elevational view of the abrading material carrier as viewed from the right of FIG. 4.
Figure 7:
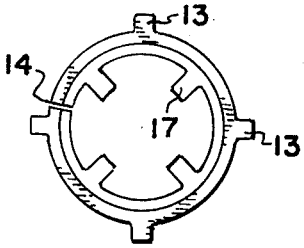
FIG. 7 is an elevational view as viewed from the left of FIG. 4 in the direction of the arrows 7—7.
Figure 8:
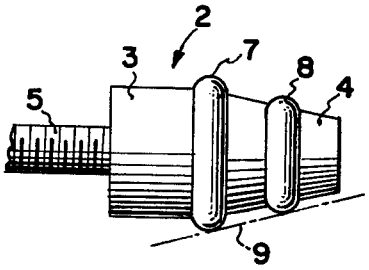
FIG. 8 is an elevational view of the body member.
Figure 9:
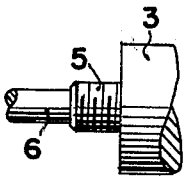
FIG. 9 is a fragmentary view of the body shown in FIG. 8 with a modified drive shaft.

If force is applied via the drive shaft 5 to move the tool 1 to the right, as viewed in FIG. 1, the end of the conduit 31 will bear against the wear ring 15 thereby effecting relative axial movement between the members 2 and 10 and in such direction as to cause the tapered surfaces 18 of the ribs 17 to slide along the plane 9, thereby effecting radial expansion of the member 10 as is permitted by the slot 14. The abrading material 16 thus will be moved toward and into engagement with the inner surface of the conduit 31, whereupon rotation of the drive shaft 5 will cause corresponding rotation of the carrier member 10 with consequent deburring, cleaning, or burnishing treatment of the inner surface of the conduit.

When the conduit treatment operation is completed, the tool 1 may be moved to the left, as viewed in FIG. 1, whereupon the spring 29 will effect axial movement of the carrier 10 relative to the body 2 and in such direction as to enable the carrier to contract radially, thereby facilitating withdrawal of the tool from the conduit.

The embodiment of the invention illustrated in FIGS. 10–13 comprises a body member 32 of cup-shaped configuration having a base 33 and an annular side wall 34. The base 33 has a central opening 35 for the accommodation of a threaded drive shaft 36 which is fixed to a guide or mandrel 37 having a tapered free end 38. Preferably, the mandrel 37 is provided with peripheral reaming teeth 39, but such teeth are not essential.

On the inner surface of the side wall 34 are fixed three pairs of roller supports 40 and 41, each of the supports 40 mounting a roller 42 and each of the supports 41 mounting a roller 43. The height of each support 41 is greater than that of its companion support 40 so that the radially inner surfaces of the rollers 42, 43 form a tapered or inclined plane 44.

On the inner surface of the side wall 34 also is fixed an axially extending, U-shaped guide member 45 for a purpose presently to be explained.

Accommodated within the body member 32 is a carrier member 46 comprising a cylindrical sleeve 47 formed of springy material and having a smooth bore to which is adhered abrading material 48. At circumferentially spaced points about its exterior the sleeve 47 is provided with axial ribs 49 corresponding in number and spacing to the rollers 42 and 43. Each rib has a smooth surface 50 on which the rollers seat. The carrier 46 also includes a radially projecting rib 51 which slidably is accommodated in the guide member 45, the members 45 and 51 constituting means for coupling the members 32 and 46 for conjoint rotation.

The inner end of the sleeve 47 has a radially inwardly directed flange or part 52 against which is seated a wear ring 53. The opposite end of the sleeve 47 is smooth and is adapted to abut a retaining flange 54 which is separably coupled to the side wall 34 by pins 55 and bayonet slots 56.

The carrier member 46 constantly is biased in a direction to abut the retainer 54 by means of a spring 57 one end of which seats upon the base 33 and the other end of which bears against a washer 58 which, in turn, abuts the inner end of the sleeve 47.

The carrier member 46 has an axial slot 59 extending the full length of the sleeve 47, the slot having a width sufficient to enable the carrier to be contracted substantially and subsequently expanded radially.

The parts of the tool are maintained in assembled relation with the driving shaft 36 by means of a nut 60. If desired, the shaft 36 may have an unthreaded shank portion 61.

To condition the tool shown in FIGS. 10–12 for treatment of the conduit 31 the free end of the latter is accommodated within the carrier member 46 while the latter is in its radially expanded condition, as shown in FIG. 10. Thereafter, the application of a force on the drive shaft 36 toward the right, as viewed in FIG. 10, will cause the free end of the conduit 31 to bear against the wear ring 53 and the flange 52 so as to effect relative axial movement of the carrier 46 and the body 32 in such direction as to cause the rollers 42 and 43 to exert an axially compressive force on the carrier, thereby moving the abrading material 48 into engagement with the external surface of the conduit 31.

If the mandrel 38 has reaming teeth 39 thereon, the size of the mandrel should be such as to enable the teeth 39 to bear against the inner surface of the conduit 31. Rotation of the tool via the drive shaft 36 thus will cause abrading of the external surface of the conduit and reaming of its internal surface.

When the treatment of the conduit 31 has been completed, movement of the tool to the left, as viewed in FIG. 10, will enable the spring 57 to move the carrier 46 axially of the body 32 and in such direction as to enable the the carrier 46 to expand radially, thereby facilitating separation of the tool and the conduit 31.

The driving mechanism for each of the disclosed tools may comprise a hand-held electric motor having a housing H through which extends a rotatable collet 62 in which is fixed a shaft 63. The shaft may be accommodated in a coupling 64 fixed at one end to the drive shaft 5, 36 and having at its other end a bayonet slot 66 for the accommodation of pins 67 fixed to the shaft 63. A flange 68 also may be fixed to the shaft 64 to abut the adjacent end of the coupling 64.

The abrading material used with each of the carrier members herein disclosed may be replaceable. Alternatively, the carrier may be impregnated with abrasive particles and the entire carrier discardable when it becomes worn.

A particular advantage of the constructions disclosed herein is that the tool operator is protected to a large extent from exposure to dust generated by treatment of the conduit.

The disclosed embodiments are representative of presently preferred forms of the invention, but are intended to be illustrative rather than definitive thereof. The invention is defined in the claims.

I claim:

1. A tool for treating an end of a conduit comprising a rotatable body member; a hollow carrier member , said carrier member being axially slit to enable radially expanding and contracting movements thereof; means coupling said body member and said carrier member for relative telescoping movements and for conjoint rotation; cooperable means on said members operable in response to relative telescoping movements thereof to effect radial expansion and contraction of said carrier; and abrading means carried by said carrier member for engagement with and disengagement from a surface of said conduit in response to said radial movements of said carrier.

2. A tool according to claim 1 wherein said body member is accommodated within said carrier member.

3. A tool according to claim 2 wherein said cooperable means comprises complementary tapering surfaces on said members confronting each other.

4. A tool according to claim 1 wherein said body member comprises a cylindrical housing within which said carrier member is accommodated.

5. A tool according to claim 4 wherein said cooperable means comprises tapering surfaces on said carrier member and bearing members carried by said body member in confronting, engaging relation with said tapering surfaces.

6. A tool according to claim 1 wherein said coupling means comprises at least one projection on one of said members accommodated in a groove formed in the other of said members.

7. A tool according to claim 6 wherein said projection is on said carrier member and said groove is in said body member.

8. A tool according to claim 1 including a guide member connected to said body member and being of such size as to be accommodated within a conduit being treated.

9. A tool according to claim 8 wherein said guide member tapers and has its surface formed as a reamer.

10. A tool for treating one end of a conduit comprising a rotatable body member tapering toward one end thereof to enable said one end to be accommodated within said conduit; a tubular carrier member telescopingly mounted on said body member and having a cylindrical outer surface and an inner surface tapered complementary to that of said body member and seated on the latter, said carrier member having an external diameter such as to enable it to be accommodated in said conduit and being axially slit to enable radial expansion of said carrier member; means coupling said members to one another for conjoint rotation; means carried by said carrier member for engagement with said conduit and being responsive to such engagement to effect relative telescoping movement of said members in a direction to cause radial expansion of said carrier member within said conduit, and abrading means carried by said carrier member on its external surface for engagement with the inner surface of said conduit in response to radial expansion of said carrier member.

11. A tool according to claim 10 including yieldable means acting on said carrier member and biasing the latter to move relative to said body member in the opposite direction.

12. A tool for treating an end of a conduit comprising a rotatable, hollow body member of such size as freely to accommodate therein said conduit end; a hollow carrier member telescopingly accommodated within said body member and having a central opening of such size as freely to accommodate therein said conduit end, said carrier member being axially slit to permit radial expansion and contraction thereof; means coupling said members for conjoint rotation; means carried by said carrier member for engagement with said end of said conduit and being responsive to such engagement to effect relative telescoping movement of said members in one direction; means responsive to said telescoping movement for contracting said carrier member radially toward and into engagement with said conduit; and abrading means carried by said carrier member in a position to engage said conduit in response to said radial contraction of said carrier member.

13. A tool according to claim 12 including yieldable means acting on said carrier member and biasing the latter to move relative to said body member in the opposite direction.

14. A tool according to claim 12 including a reamer carried by said body member in a position to be accommodated in said conduit when the latter is accommodated within said carrier member.

15. A tool according to claim 12 wherein said means for contracting said carrier comprises rollers carried by said body member in engagement with tapered surfaces on said carrier member.

* * * * *